US006309812B1

(12) United States Patent
Aogaki et al.

(10) Patent No.: US 6,309,812 B1
(45) Date of Patent: Oct. 30, 2001

(54) EMULSIFIED DISPERSION OF PHOTOGRAPHIC HYDROPHOBIC COMPOUND AND SILVER HALIDE PHOTOGRAPHIC LIGHT-SENSITIVE MATERIAL

(75) Inventors: Yukio Aogaki; Masahiro Fukuoka, both of Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/184,939

(22) Filed: Nov. 3, 1998

(30) Foreign Application Priority Data

Nov. 6, 1997 (JP) ..... 9-304270

(51) Int. Cl.[7] ..... G03C 1/08; G03C 7/26; G03C 7/32

(52) U.S. Cl. ..... 430/546; 430/631; 430/377; 430/449

(58) Field of Search ..... 430/546, 631, 430/377, 449

(56) References Cited

U.S. PATENT DOCUMENTS

| | | | |
|---|---|---|---|
| 2,322,027 | | 6/1943 | Jelley et al. . |
| 3,623,877 | | 11/1971 | Langley . |
| 4,080,211 | | 3/1978 | Van Paesschen et al. . |
| 5,380,628 | * | 1/1995 | Sawyer et al. ..... 430/449 |

FOREIGN PATENT DOCUMENTS

| | | |
|---|---|---|
| 0683429A1 | 11/1995 | (EP) . |
| 0895119A1 | 2/1999 | (EP) . |
| 1193349 | 5/1970 | (GB) . |

OTHER PUBLICATIONS

Chemical Abstracts, vol. 90, No. 20, May 14, 1979 XP00209'6308.

* cited by examiner

*Primary Examiner*—Geraldine Letscher
(74) *Attorney, Agent, or Firm*—Birch, Stewart, Kolasch & Birch, LLP

(57) ABSTRACT

There is disclosed an emulsified dispersion of photographic hydrophobic compound fine grains (with a proviso of excluding silver halides), which comprises an added water-soluble monovalent- or polyvalent-metal salt. The emulsified dispersion whose particle size is small, is excellent in the stability of the particle size with the lapse of time. There is also disclosed a silver halide photographic light-sensitive material, which contains the emulsified dispersion.

29 Claims, 4 Drawing Sheets

EMULSIFIED DISPERSION OF PHOTOGRAPHIC HYDROPHOBIC COMPOUND AND SILVER HALIDE PHOTOGRAPHIC LIGHT-SENSITIVE MATERIAL

FIELD OF THE INVENTION

The present invention relates to a photographic technique, and particularly to an emulsified dispersion of photographic hydrophobic compound fine particles, wherein, by adding a water-soluble metal salt, particle size atomization and particle size stabilization after the passage of time have been attained; the invention also relates to a method of preparing the emulsified dispersion, and to a silver halide photographic light-sensitive material containing that emulsified dispersion.

BACKGROUND OF THE INVENTION

It is known that, when a silver halide color photographic light-sensitive material is exposed to light and then subjected to color-development, an oxidized aromatic primary amine developing agent and a coupler are reacted, to produce indophenols, indoanilines, indamines, azomethines, phenoxazines, phenazines, and similar dyes, to form a color image. In this system, for the color reproduction, generally the subtractive color process is employed, and use is made of silver halide emulsions selectively photosensitive to blue, green, and red, and yellow, magenta, and cyan color couplers in color relation complementary to them, respectively.

In the meantime, in a multilayer color light-sensitive material, in order to reduce the color mixing and to improve the color reproduction, it is required to fix couplers in separate layers. To make these couplers nondiffusible, many methods are known.

Representative examples of these methods include the introduction of a long-chain aliphatic group into the molecule of a low-molecular coupler, in order to prevent the diffusion; and the polymerization as described in U.S. Pat. No. 4,080,211.

Since such couplers themselves are immiscible with aqueous binder (particularly gelatin) solutions, they are generally used in the form of a dispersion.

Thus, as an example of a method for making a water-insoluble coupler into an aqueous dispersion, a method as described in U.S. Pat. No. 2,322,027 can be mentioned, wherein a coupler is dissolved in a high-boiling organic solvent, and the resultant solution is emulsified and dispersed into an aqueous gelatin solution.

However, in the emulsified dispersion of the thus-obtained hydrophobic compound fine particles, there is a problem that the particle size is large or becomes large as a result of coalescence/aggregation or the like with lapse of time, leading to a decrease in color density and an occurrence of application (surface state) trouble.

SUMMARY OF THE INVENTION

Therefore, an object of the present invention is to provide an emulsified dispersion whose particle size is small and the stability of the particle size after the lapse of time (the stability of the dispersed particle size with lapse of time when the medium is in the state of sol) is excellent.

Another object of the present invention is to provide a silver halide photographic light-sensitive material containing this emulsified dispersion.

Other and further objects, features, and advantages of the invention will appear more fully from the following description, taken in connection with the accompanying drawings.

DETAILED DESCRIPTION OF THE INVENTION

Figure 1:
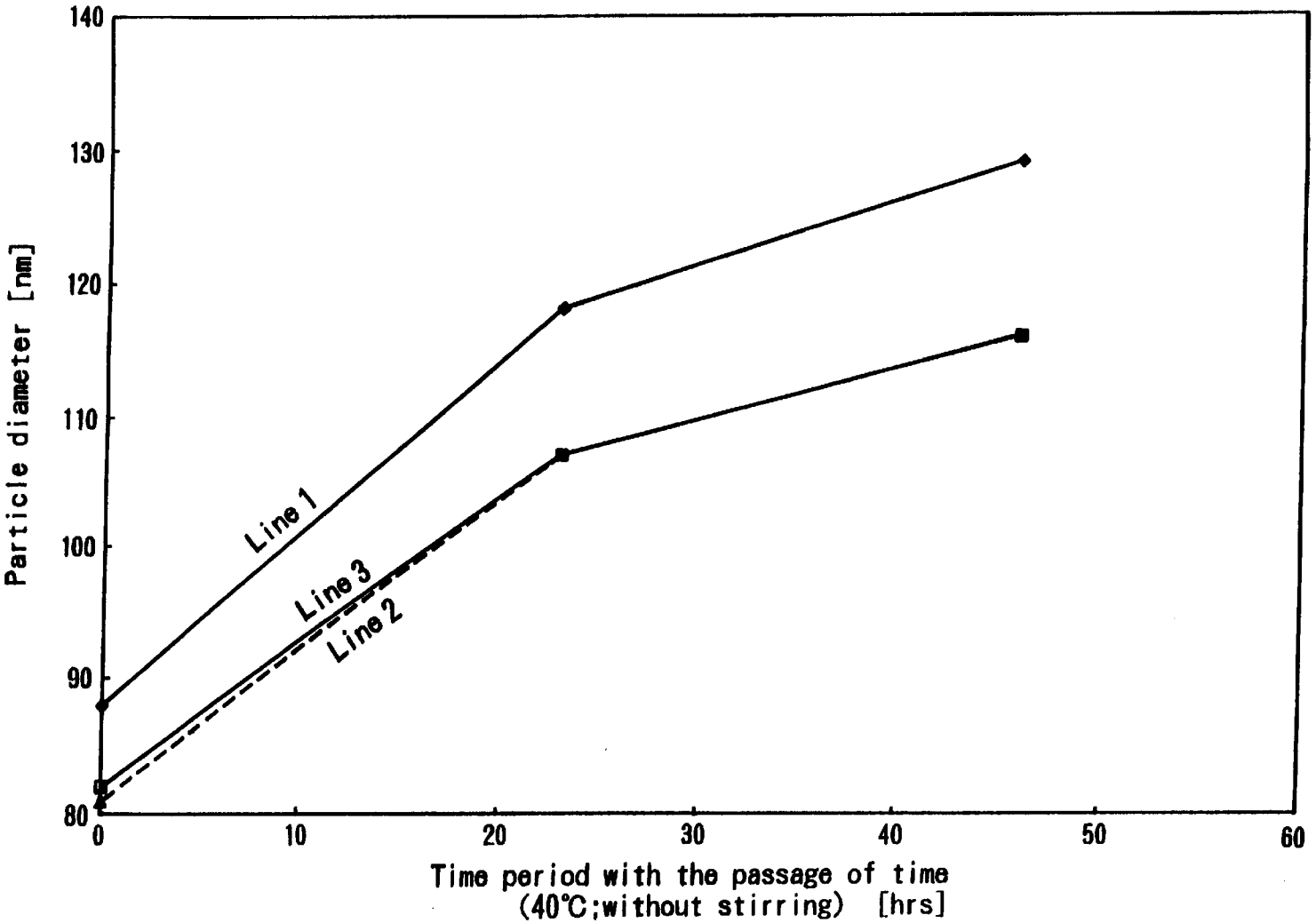
FIG. 1 shows the changes of particle diameters when emulsified dispersions are dissolved and stood.

The inventors of the present invention, having investigated intensively in various ways; have found that the above objects can be attained by adding a water-soluble metal salt to an aqueous phase before the completion of emulsification, and/or to an emulsified dispersion after emulsification, leading to completion of the present invention. Namely, the present invention is directed to the following emulsified dispersion and silver halide photographic light-sensitive material containing that emulsified dispersion:

(1) A dispersion, which comprises a prescribed amount of an added water-soluble monovalent- or polyvalent-metal salt, wherein photographic hydrophobic compound fine particles (with a proviso of excluding silver halides) are emulsified and dispersed;

(2) The emulsified dispersion of photographic hydrophobic compound fine particles as stated in the above (1), wherein the metal salt is a divalent- or trivalent-metal salt;

(3) The emulsified dispersion of photographic hydrophobic compound fine particles as stated in the above (2), wherein the divalent- or trivalent-metal salt is at least one metal salt selected from among calcium salts, magnesium salts, barium salts, and aluminum salts;

(4) An emulsified dispersion of photographic hydrophobic compound fine particles (with a proviso of excluding silver halides), comprising a water-soluble monovalent-metal salt added in an added amount of 70 mmol to 700 mmol per 1,000 g of the hydrophobic compound fine particles in the emulsion;

(5) The emulsified dispersion of photographic hydrophobic compound fine particles as stated in one of the above (1) to (4), wherein the metal salt is a nitrate; and (6) A silver halide photographic light-sensitive material, comprising the emulsified dispersion of photographic hydrophobic compound fine particles stated in one of the above (1) to (5), in at least one hydrophilic colloid layer coated on a base.

Hereinbelow the present invention is described in detail.

In the present invention, the term "an added water-soluble metal salt" means a water-soluble metal salt added into an aqueous medium before the completion of emulsification, or into an emulsified dispersion after emulsification, and it excludes, for example, the mode in which a water-soluble metal salt inevitably included in gelatin is automatically (unavoidably) added along with the addition of that gelatin.

The added amount of the water-soluble metal salt added in the present invention is the amount required for lowering the surface tension to sufficiently assist the action of an anionic surfactant used for emulsification and dispersion, and specifically in the case of a monovalent-metal salt, it is required to add 70 mmol to 700 mmol, and preferably 280 mmol to 530 mmol, per 1,000 g of the hydrophobic compound fine particles in the emulsion. Further in the case of a polyvalent-metal salt, the amount to be added is preferably 7 mmol to 70 mmol, and more preferably 28 mmol to 53 mmol.

In the present invention, the metal salt added dissociates into a ion in the emulsified dispersion. As a monovalent metal ion, $K^+$, $Na^+$, and $Li^+$ can be mentioned, with preference given to $K^+$ and $Na^+$. As a polyvalent metal ion, a divalent or trivalent metal ion is preferable, and in particular a divalent metal ion is preferable.

As a trivalent metal ion, $Al^{3+}$ is preferable, and as a divalent metal ion, $Ca^{2+}$, $Mg^{2+}$, and $Ba^{2+}$ are preferable.

As a monovalent-metal salt, nitrates, sulfates, carbonates, and phosphates are preferable, and nitrates are particularly preferable, because they do not bring about photographically adverse influences. Further, even in the case of a polyvalent-metal salt, when a water-soluble metal salt is added to an aqueous medium (aqueous phase) before the completion of emulsification, the particle diameter after the emulsification can be reduced in the fine particle size of 0.30 $\mu$m or less, preferably 0.25 $\mu$m or less, and more preferably 0.05 to 0.20 $\mu$m, and the change in the particle diameter of the emulsified dispersion with lapse of time can be reduced remarkably. Further, when it is added after the emulsification, the change in the particle diameter with lapse of time can be reduced remarkably. Particularly, preference is given to the method wherein a monovalent- or polyvalent-metal salt is added after the emulsification, because it is a quite effective method that can reduce remarkably the change in particle size due to the passage of time.

Meanwhile, compared with a monovalent-metal salt, a divalent- or trivalent-metal salt has such an advantage that the amount to be added necessary to attain the object of the present invention can be small. However, on the other hand, when a silver halide photographic light-sensitive material wherein use is made of an emulsified dispersion obtained by using a divalent- or trivalent-metal salt is subjected to development, the divalent- or trivalent-metal salt dissolved out from the emulsion accumulates in the developing processing solution; and it, together with an oxidized product of the developing agent and gelatin that has also been dissolved out, forms an agglomerate. Therefore, the addition of a divalent- or trivalent-metal salt for obtaining an emulsified dispersion involves a difficulty on the adjustment of the amount to be added. A monovalent-metal salt is more preferable, since the above problem is not involved.

Examples of the hydrophobic compound used in the present invention are water-insoluble and/or oil-soluble photographic additives, including a variety of color couplers, non-dye-forming couplers, dyes, color-mixing inhibitors, image stabilizers, etc., known in the field of photographic technology. Among these, a representative of the water-insoluble additives is a solid dispersed dye.

High-boiling organic solvents used for dissolving the oil-soluble photographic additives may be solid or liquid at room temperature; and, for example, phosphates, carboxylates, amides, anilines, and ethers, represented by one of formulas (I), (II), (III), (IV), and (V), and their specific examples, described in JP-A-62-172349 ("JP-A" means unexamined published Japanese patent application), are preferable.

Thus, in the emulsified dispersion of photographic hydrophobic compound fine particles of the present invention, the hydrophobic compound fine particles may be a dispersion of fine particles of the above hydrophobic compound itself, or a dispersion of one or more of the above hydrophobic compounds in the form of fine oil droplets dissolved in a high-boiling organic solvent that is solid or liquid at room temperature. Further, the hydrophobic compound may be formed into a dispersion of fine particles impregnated into a polymer particle.

The content (concentration) of the photographic hydrophobic compound in the emulsified dispersion of the present invention is not particularly limited, and it varies depending, for example, on the type and the use of the photographic hydrophobic compound to be dispersed, and the content is not particularly different from that of conventional similar emulsified dispersions.

As a specific example, the amount of the hydrophobic compound, such as a coupler, an anti-fading agent, a UV absorber, and a color-mixing inhibitor, to be used in the emulsion in relation to the solids, is preferably 2 to 20% by weight.

Further, into the photographic emulsified dispersion of the present invention, may suitably be added a protective colloid substance (hydrophilic colloid), in order to improve the stability of the emulsion. Such a protective colloid substance includes, for example, gelatin, gelatin derivatives, polyvinyl alcohols, and modified polyvinyl alcohols.

In the photographic emulsified dispersion of the present invention, the amount of water (an aqueous phase) employed is the amount of parts other than oil-phase components, such as photographic hydrophobic compounds, and silver halide grain components. Thus the amount of water can be suitably determined depending on, for example, types and use of the emulsified dispersion, and it is not particularly limited to a range, but is preferably 10 to 90% by weight, and more preferably 40 to 80% by weight, to the total amount of the photographic emulsified dispersion.

As an anionic surfactant preferably used in the present invention, one may be chosen from those represented by the following formula [I]:

$$R—(A)_n—B \qquad \text{formula [I]}$$

wherein R represents an alkyl group, an alkenyl group, an aralkyl group, each of which groups has 4 to 24 carbon atoms, or a fluorinated hydrocarbon group formed by replacing a hydrogen atom(s) of these groups with a fluorine atom(s); A represents a divalent linking group, n is 0 or 1, and B represents a sulfonic acid group, a sulfonate group, a carboxylic acid group, a phosphonic acid group, a phosphonate group, a phosphite group, or a salt thereof. B is particularly preferably a sulfonic acid group.

Specific examples of the divalent group represented by A are given below.

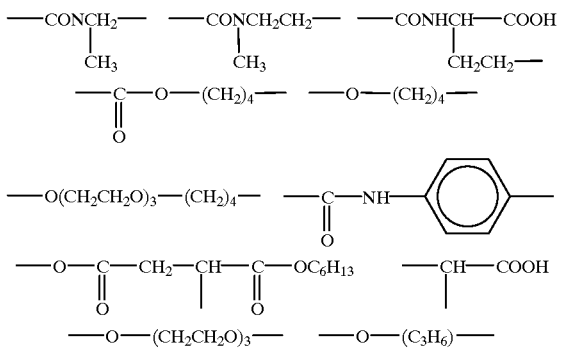

-continued $$-NH-(CH_2)_3-$$

Specific examples of the anionic surfactant that can be used in the present invention are shown below, but the present invention is not limited to these.

1 $C_{11}H_{23}COONa$

2 $C_{11}H_{23}CON(CH_3)CH_2COONa$

3 $C_{11}H_{23}CON(CH_3)-CH_2CH_2COONa$

4 $C_{11}H_{23}CON(CH_2CH_2COOH)-CH_2-COOH$

5 $C_{12}H_{25}SO_3Na$

6 One whose base is an α-olefinsulfonate (LIPORAN-1400; trade name, manufactured by Lion Co.)

7 $C_{12}H_{25}O(CH_2)_4SO_3Na$

8 $C_{17}H_{33}CONH(CH_2)_4SO_3Na$

9

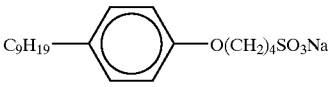

10

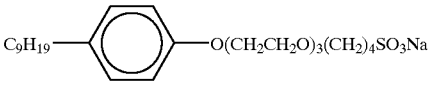

11

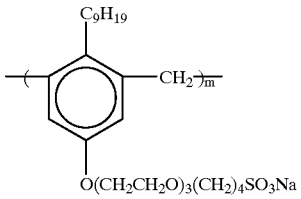

m ≒ 5

12

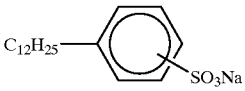

13

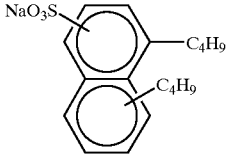

14 $C_{17}H_{33}CON(CH_3)-CH_2CH_2SO_3Na$

-continued

15

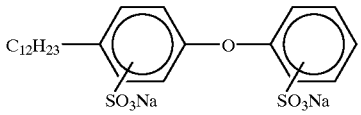

16 $CH_2COOC_6H_{13}(n)$ | $CHCOOC_6H_{13}(n)$ | $SO_3Na$

17 $CH_2COOCH_2CH(C_2H_5)C_4H_9$ | $CHCOOCH_2CH(C_2H_5)C_4H_9$ | $SO_3Na$

18

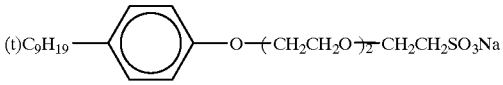

19 $C_{12}H_{25}OSO_3Na$

20

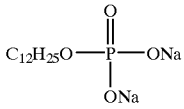

21

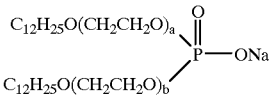

(wherein a and b each are an integer of 1 or more.)

22

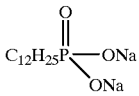

23 $(n)C_{16}H_{33}O(C_3H_6O)_3SO_3Na$

24 $C_8H_{17}CH(C_6H_{13})CH_2O(C_3H_6O)_3SO_3Na$

25 $C_8F_{17}SO_3K$

26 $C_8F_{17}SO_2N(C_3H_7)-CH_2COOK$

27

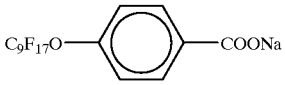

28

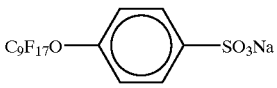

29 $C_8F_{17}SO_2N(C_3H_7)-(CH_2CH_2O)_4(CH_2)_4SO_3Na$

-continued

30

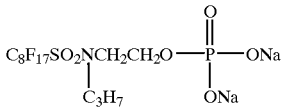

31

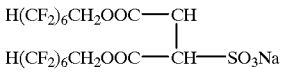

The amount of the anionic surfactant to be used is not particularly limited, but it is preferably 2.5% by weight or more, and more preferably 4 to 20% by weight, to the gelatin used for emulsification.

It is enough that the light-sensitive material of the present invention has at least one layer containing the emulsified dispersion of the present invention on a base, and the emulsified dispersion is contained in a hydrophilic colloid layer made of a usual gelatin binder. The light-sensitive material of the present invention may be a black-and-white light-sensitive material or a color light-sensitive material. A general color light-sensitive material can be constructed by applying, onto a base, at least one blue-sensitive silver halide emulsion layer, at least one green-sensitive silver halide emulsion layer, and at least one red-sensitive silver halide emulsion layer, which layers may be in any order. Further, an infrared-sensitive silver halide emulsion layer can be used instead of at least one of the light-sensitive emulsion layers. By containing silver halide emulsions having sensitivities in respective wavelength ranges and couplers capable of forming dyes having relations complementary to the lights to which the silver halide emulsions are sensitive into these light-sensitive emulsion layers, the color reproduction by the subtractive color process can be effected. However, the light-sensitive emulsion layers and the color-formed hues of the couplers may not have the above correspondence.

In the silver halide photographic light-sensitive material of the present invention, other conventionally known photographic materials and additives can be used.

For example, as the photographic base (support), a transmission-type base or a reflective-type base can be used. As the transmission-type base, a cellulose triacetate film and a transmission film made, for example, of a polyethylene terephthalate, as well as a film made, for example, of a polyester of 2,6-naphthalenedicarboxylic acid (NDCA) and ethylene glycol (EG), or a polyester of NDCA, terephthalic acid, and EG, which film is provided with an information recording layer, such as a magnetic layer, are preferably used. As the reflective-type base, particular preference is given to a reflective-type base laminated with several polyethylene layers or polyester layers and containing a white pigment, such as titanium oxide, in at least one of such water-resistant resin layers (lamination layers).

Further, preferably the above water-resistant resin layers contain a fluorescent whitening agent. Furthermore, a fluorescent whitening agent may be dispersed in a hydrophilic colloid layer of the light-sensitive material. As the fluorescent whitening agent, preferably those of a benzoxazole-series, a cumarin-series, and a pyrazoline-series can be used, and more preferably, fluorescent whitening agents of a benzoxazolylnaphthalene-series and a benzoxazolylstylbene-series are used. The amount to be used is not particularly limited, but it is preferably 1 to 100 $mg/m^2$. When it is mixed with the water-resistant resin, the mixing ratio is preferably 0.0005 to 3% by weight, and more preferably 0.001 to 0.5% by weight, to the resin.

The reflective-type base may be one formed by applying a hydrophilic colloid layer containing a white pigment on a transmission-type base or a reflective-type base as mentioned above.

Further, the reflective-type base may be a base having a specular reflective or a second-class diffuse reflective metallic surface.

As the silver halide emulsion used in the present invention, for example, a silver chloride, silver bromide, silver iodobromide, or silver chloro(iodo)bromide emulsion can be used, and in view of rapid processability, a silver chloride or silver chlorobromide emulsion having a silver chloride content of 95 mol % or more is preferable, with more preference given to a silver halide emulsion having a silver chloride content of 98 mol % or more. Among such silver halide emulsions, one having a localized silver bromide phase on the surface of each of the silver chloride grains is particularly preferable, because high sensitivity can be obtained, and in addition the photographic performance can be stabilized.

The following materials and methods described in patents listed in Tables 1 and 2, can be preferably applied in the present invention: the above reflective-type base and silver halide emulsion, as well as different metal ion species to be doped into the silver halide grains; storage stabilizers or antifoggants, chemical sensitizing methods (sensitizers), and spectral sensitizing methods (spectral sensitizers) of the silver halide emulsion; cyan, magenta, and yellow couplers; methods for emulsifying and dispersing these couplers, color-image preservation improvers (anti-staining agents and anti-fading agents), dyes (colored layers), gelatin species, the constitution of layers of the light-sensitive material, the film pH of the light-sensitive material, and the like.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptheterocyclic compounds) |
| Chemical sensitizing methods (Chemical sensitizers) | Column 74, line 45 to Column 75, line 6 | Column 47, lines 7 to 17 | Column 81, lines 9 to 17 |

TABLE 1-continued

| Element | JP-A-7-104448 | JP-A-7-77775 | JP-A-7-301895 |
|---|---|---|---|
| Spectrally sensitizing methods (Spectrally sensitizers) | Column 75, line 19 to Column 76, line 45 | Column 47, line 31 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 31 to Column 64, line 11 | Column 32, line 34 to Column 77, line 44 and column 89, lines 32 to 46 |
| Emulsifying and dispersing methods of couplers | Column 71, line 3 to Column 72, line 11 | Column 61, lines 36 to 49 | Column 87, lines 35 to 48 |

TABLE 2

| Element | JP-A-7-104448 | JP-A-7-77775 | JP-A-7-301895 |
|---|---|---|---|
| Dye-image-preservability improving agents (anti-staining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (colored layers) | Column 77, line 42 to Column 78, line 41 | Column 7, line 14 to Column 19, line 42 and Column 50, line 3 to Column 51, line 14 | Column 9, line 27 to Column 18, line 10 |
| Geratins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coatings of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As the cyan, magenta, and yellow couplers used in the present invention, further, couplers described in JP-A-62-215272, page 91, right upper column, line 4, to page 121, left upper column, line 6; JP-A-2-33144, page 3, right upper column, line 14, to page 18, left upper column, last line, and from page 30, right upper column, line 6, to page 35, right lower column, line 11; and EP 0355,660 A2, page 4, line 15, to line 27, and from page 5, line 30, to page 28, last line, and from page 45, line 29, to line 31, and from page 47, line 23, to page 63, line 50, are also useful.

As bacteria-proofing/mildew-proofing agents that can be used in the present invention, those described in JP-A-63-271247 are useful. As hydrophilic colloids used in photographic layers that constitute the light-sensitive material, gelatin is preferable, and, in particular, heavy metals contained therein as impurities, such as iron, copper, zinc, and manganese, are preferably in an amount of 5 ppm or less, and more preferably 3 ppm or less.

The light-sensitive material of the present invention is used in a usual printing system, in which a negative printer is used, and it is also suitable for a scanning exposure system, in which a cathode ray (CRT) or a laser is used.

According to the present invention, an emulsified dispersion wherein the particle size is small and the change in the particle diameter due to the lapse of time is small, can be obtained, and by using this coupler emulsified dispersion, a color photographic light-sensitive material high in color forming property and stabilized in color density can be obtained.

Further, the emulsified dispersion prepared in accordance with the present invention using a color-mixing inhibitor in place of a coupler, has an effect that the ability for preventing colors from mixing is increased or is obtained stably.

The present invention will now be described in more detail with reference to the following examples, but the invention is not limited to them.

EXAMPLES

Example 1

Liquid (1) and Liquid (2) each having the composition shown below were mixed using a homogenizer, and after the emulsification, an additional water (6610 ml) was added, to prepare 15 kg of Emulsified Dispersion 1.

| Liquid (1) (aqueous phase) | |
|---|---|
| gelatin* | 1,000 g |
| water | 4,000 ml |

-continued

| Liquid (2) (oil phase) | |
|---|---|
| cyan coupler | 1,030 g |
| ultraviolet light absorber | 422 g |
| high-boiling organic solvent (dibutyl phthalate) | 620 ml |
| ethyl acetate | 1,300 ml |
| surfactant (the above exemplified compound 12) (72%) | 124 ml |

*The gelatin used had a $Ca^{2+}$ content of 50 ppm.

Cyan Coupler

A mixture of

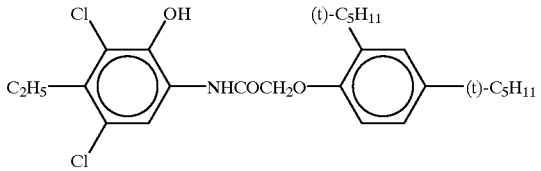

and

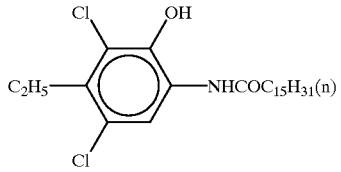

(weight ratio 1:4)

UV Absorber

A mixture (in a weight ratio of 1.6:1:1.5) of

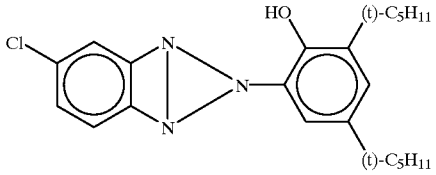

and

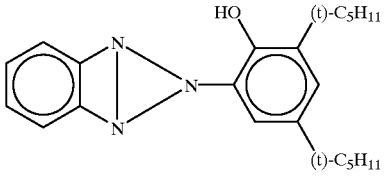

and

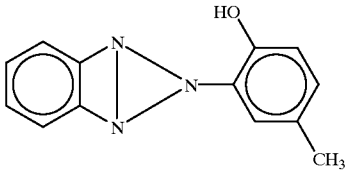

In the above Emulsified Dispersion 1, the kind of the water-soluble metal salt to be added, the amount to be added thereof, and the time when the addition thereof was made were varied, to prepare various emulsified dispersions; then, the particle diameter immediately after the preparation, and the particle diameter after allowing each of the emulsified dispersions to stand at 40° C., were measured using the light-scattering method, and the stability with lapse of time was evaluated.

The obtained results on the particle size of the emulsified dispersions are shown in FIGS. 1 to 4. FIG. 1 shows the particle diameters (nm) immediately after the emulsification and dispersion, and the change of the particle diameters with lapse of time, wherein Line 1 is when no water-soluble metal salt was added, Line 2 is when 60 mmol of calcium nitrate was added to Liquid (1) of Emulsified Dispersion 1, and Line 3 is when 60 mmol of magnesium nitrate was added to Liquid (1) of Emulsified Dispersion 1.

Figure 2:
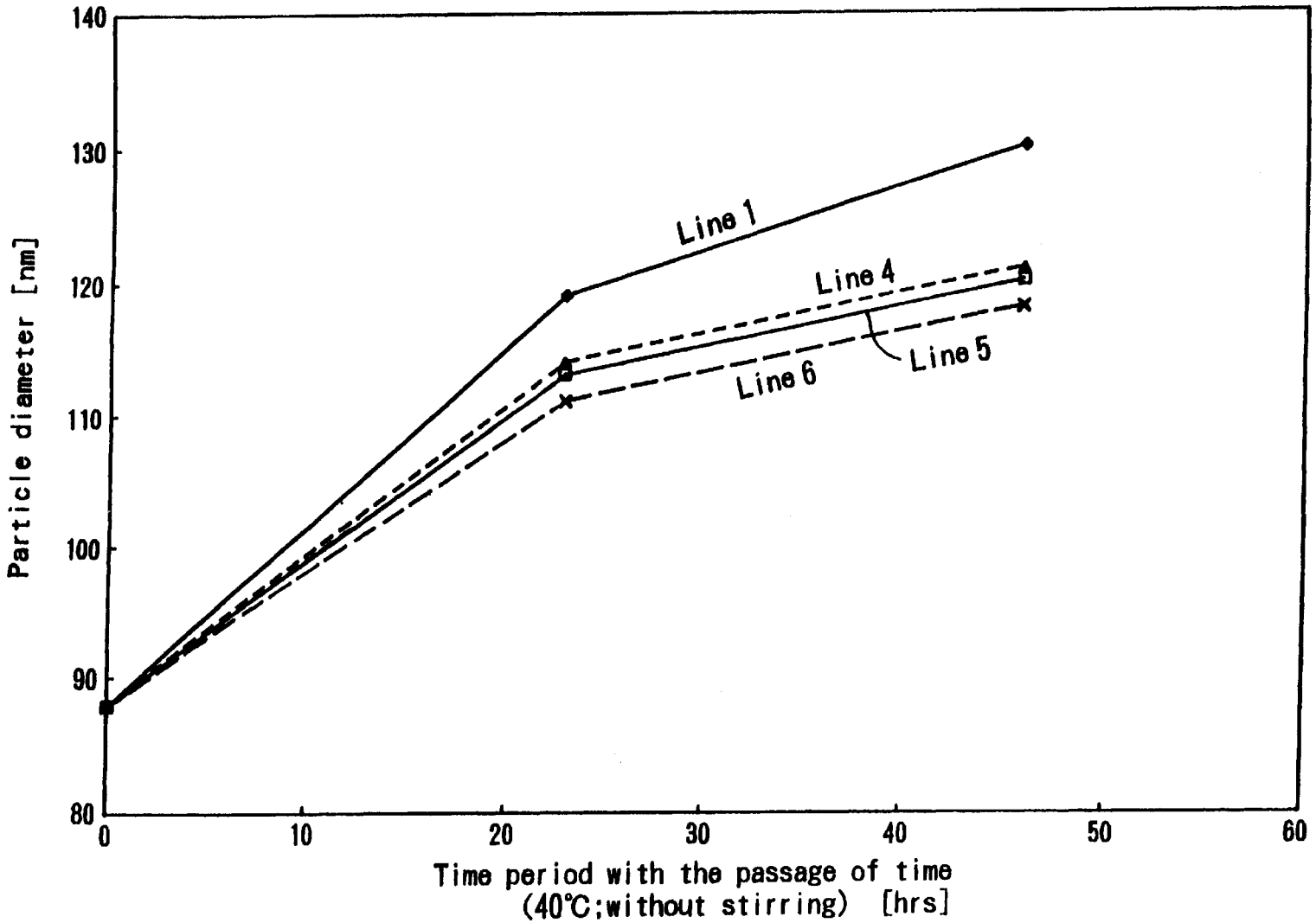
FIG. 2 shows the changes of particle diameters when emulsified dispersions are dissolved and stood.

FIG. 2 shows the changes of the particle diameters with lapse of time, wherein Line 4 is when 60 mmol of magnesium nitrate was added immediately after the preparation of Emulsified Dispersion 1, Line 5 is when 60 mmol of calcium nitrate was added to Emulsified Dispersion 1, and Line 6 is when 60 mmol of barium nitrate was added to Emulsified Dispersion 1.

Figure 3:
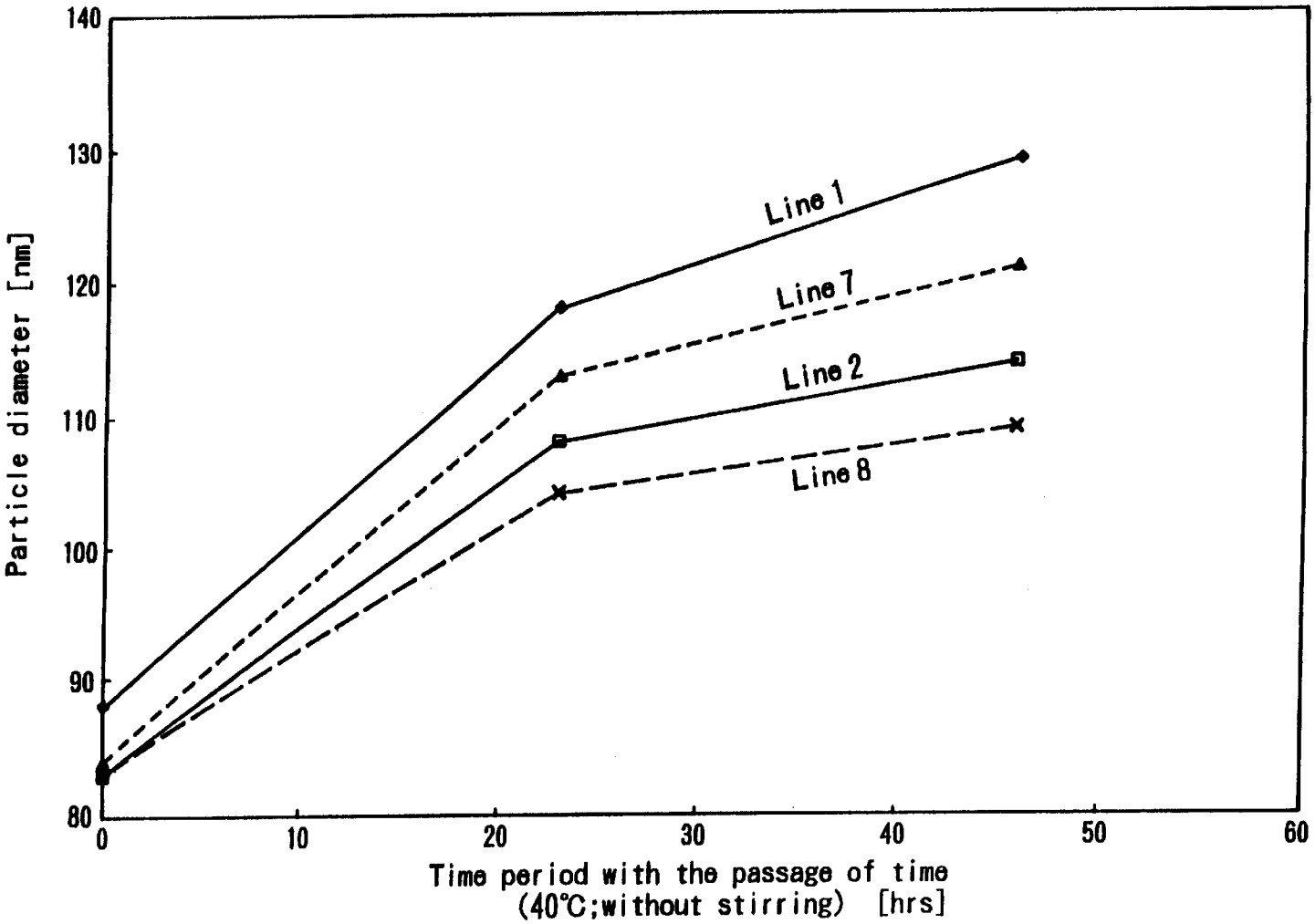
FIG. 3 shows the changes of particle diameters when emulsified dispersions are dissolved and stood.

FIG. 3 shows the changes of the particle diameters (particle size) when the added amount of calcium nitrate added to Liquid (1) of Emulsified Dispersion 1 was changed, in which Line 7 is when 30 mmol of calcium nitrate was added, and Line 8 is when 120 mmol of calcium nitrate was added.

Figure 4:
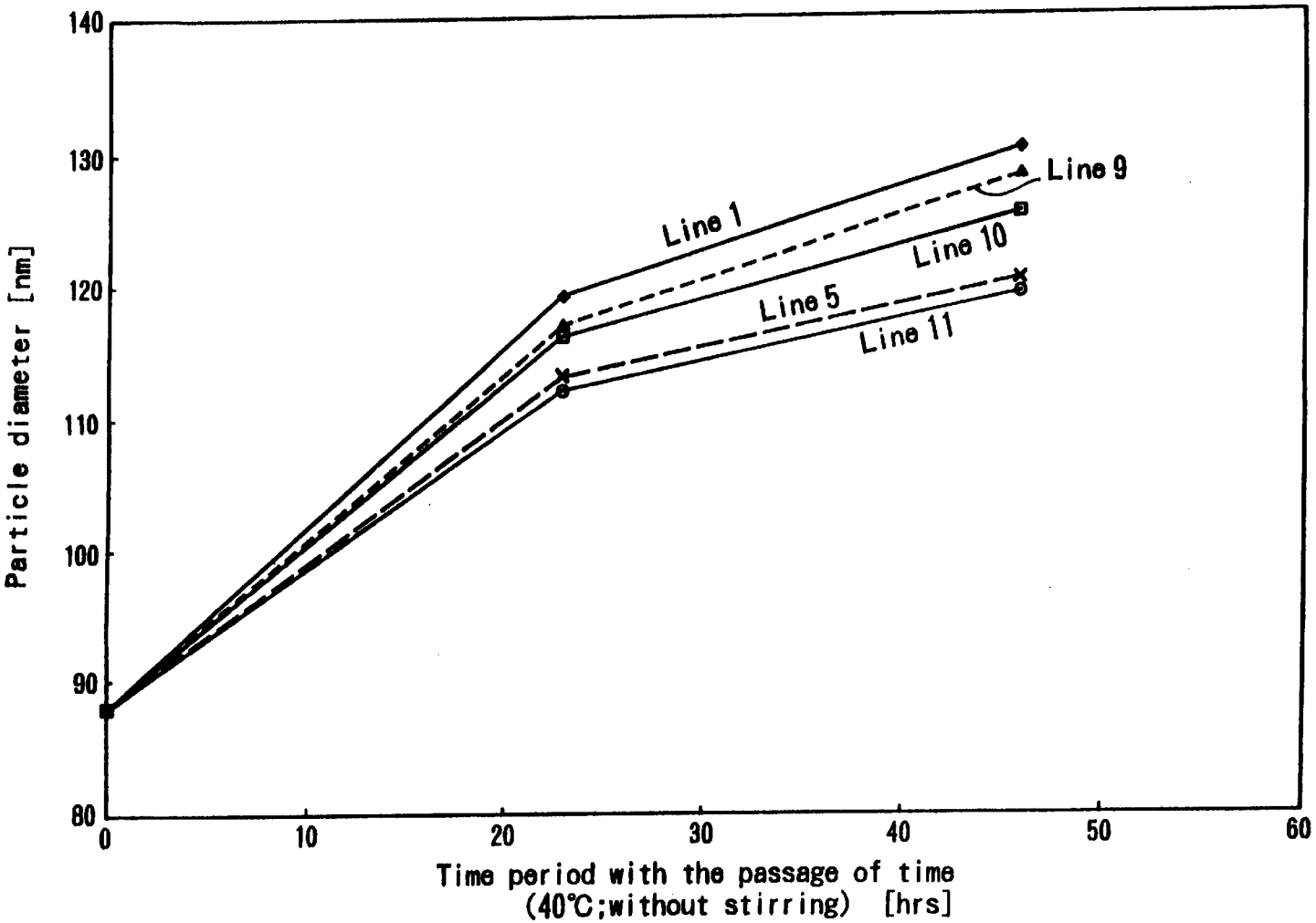
FIG. 4 shows the changes of particle diameters when emulsified dispersions are dissolved and stood.

FIG. 4 shows the changes of the particle diameters when sodium nitrate was added to Emulsified Dispersion 1 immediately after its preparation, in which Line 9 is when 60 mmol of sodium nitrate was added, Line 10 is when 300 mmol of sodium nitrate was added, and Line 11 is when 600 mmol of sodium nitrate was added.

The following-can be understood from the results shown in FIGS. 1 to 4. From the results shown in FIG. 1, it can be understood that, when a water-soluble polyvalent-metal salt was added to an aqueous phase before the emulsification and dispersion, an emulsified dispersion could be obtained in which, in comparison to when that metal salt was not added, the particle diameter was small and the change of the particle diameter with lapse of time was relatively small (which means that the stability with lapse of time was excellent).

From the results shown in FIG. 2, it can be understood that, even when a water-soluble polyvalent-metal salt was added after the preparation of an emulsified dispersion, the stability with lapse of time of the particle size of the emulsion was remarkably improved, in comparison with when that water-soluble polyvalent-metal salt was not added.

From the results shown in FIG. 3, it can be understood that, as the added amount of a water-soluble polyvalent-metal salt to be added to an aqueous phase before the emulsification and dispersion was increased, the particle size of the emulsion could be decreased, and the stability with lapse of time could be improved as well.

From the results shown in FIG. 4, it can be understood that, when the added amount of a water-soluble monovalent-metal salt was 60 mmol, the effect of improving the stability with lapse of time was relatively small, whereas when it was added in an amount of 300 mmol, its improving effect became remarkable, and when it was added in an amount of 600 mmol, unexpectedly the stability with lapse of time was remarkably improved, to the same extent as or more than when 60 mmol of a water-soluble polyvalent-metal salt was added.

Example 2

After the surface of a base prepared by covering both surfaces of a sheet of paper with a polyethylene resin was subjected to corona discharge treatment, a gelatin undercoat layer containing sodium dodecylbenzenesulfonate was provided, and the below-shown silver halide emulsion layer and a gelatin protective layer were successively applied, to prepare a color photographic light-sensitive material.

Preparation of Silver Halide Emulsion Layer Coating Solution

The term "an average grain size" used hereinbelow means the average value of diameters of circles having the same areas as those of grains measured by the so-called projected area method.

A silver chlorobromide emulsion (cubes; a mixture of a large-size emulsion C, having an average grain size of 0.50 μm, and a small-size emulsion C, having an average grain size of 0.41 μm, in a ratio of 1:4 in terms of mol of silver; the deviation coefficients of the grain size distributions being 0.09 and 0.11, respectively; and 0.5 mol % of silver bromide being contained in each of the emulsions locally in part of the surfaces of the grains whose substrate was made of silver chloride) was prepared.

In this emulsion, the below-shown red-sensitive sensitizing dyes G and H were added, each in an amount of $6.0\times10^{-5}$ mol per mol of silver to the large-size emulsion, and each in an amount of $9.0\times10^{-5}$ mol per mol of silver to the small-size emulsion. Further, chemical ripening of this emulsion was optimally carried out by adding a sulfur sensitizer and a gold sensitizer.

For comparison, Emulsion Layer Coating Solution 1 was prepared by mixing and dissolving the Emulsified Dispersion 1 and the above silver chlorobromide emulsion. Further, Emulsion Layer Coating Solution 2 was prepared by mixing and dissolving the Emulsified Dispersion 2 of a cyan coupler as prepared in Example 1 (one obtained by adding 60 mmol of calcium nitrate to Liquid (1) of Emulsified Dispersion 1) and the above silver chlorobromide emulsion.

(Sensitizing dye G)

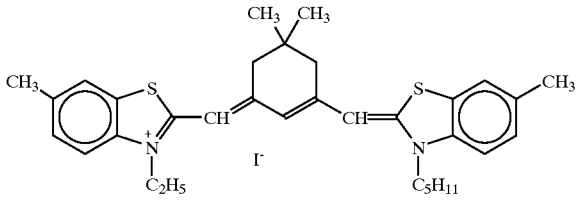

(Sensitizing dye H)

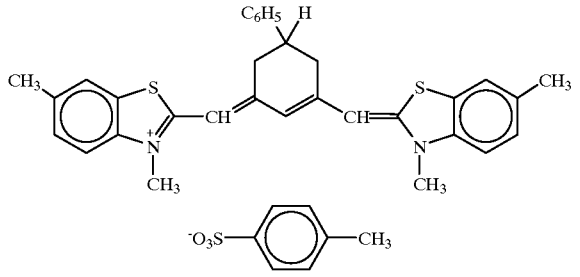

Light-Sensitive Materials 1 and 2, prepared by applying these Emulsion Layer Coating Solutions 1 and 2 respectively, were exposed to light through an exposure wedge and were subjected to rapid color development processing for a development time of 45 sec. Thus, it was found that, in comparison with Light-Sensitive Material 1, wherein Emulsified Dispersion 1 for comparison was used, Light-Sensitive Material 2, wherein Emulsified Dispersion 2 of the present invention was used, gave a higher maximum color density; that is, it was improved in color-forming property.

Further, similarly, when magnesium nitrate or barium nitrate was added instead of calcium nitrate, the color-forming property was improved.

Having described our invention as related to the present embodiments, it is our intention that the invention not be limited by any of the details of the description, unless otherwise specified, but rather be construed broadly within its spirit and scope as set out in the accompanying claims.

What we claim is:

1. A dispersion, which comprises an added water-soluble monovalent- or polyvalent-metal inorganic salt with a prescribed amount required for lowering the surface tension in association with an anionic surfactant, wherein photographic hydrophobic compound fine particles are emulsified in the presence of an anionic surfactant, in the form of fine oil droplets dissolved in a high-boiling organic solvent that is solid or liquid at room temperature.

2. The dispersion as claimed in claim 1, wherein the water-soluble monovalent- or polyvalent-metal salt is selected from the group consisting of nitrates and carbonates, and wherein photographic hydrophobic compound fine particles (with the proviso of excluding silver halides) are emulsified.

3. The emulsified dispersion of photographic hydrophobic compound fine particles as claimed in claim 1, wherein the metal salt is a divalent- or trivalent-metal salt.

4. The emulsified dispersion of photographic hydrophobic compound fine particles as claimed in claim 3, wherein the divalent- or trivalent-metal salt is at least one metal salt selected from among calcium salts, magnesium salts, barium salts, and aluminum salts.

5. The emulsified dispersion of photographic hydrophobic compound fine particles as claimed in claim 1, wherein the metal salt is a nitrate.

6. The emulsified dispersion of photographic hydrophobic compound fine particles as claimed in claim 1, wherein the water-soluble monovalent- or polyvalent-metal salt is added into an aqueous medium before the completion of emulsification.

7. The emulsified dispersion of photographic hydrophobic compound fine particles as claimed in claim 1, wherein the emulsified dispersion of photographic hydrophobic compound fine particles is prepared by adding the metal salt into the emulsified photographic hydrophobic compound after the completion of emulsification.

8. The dispersion as claimed in claim 1, wherein the water-soluble monovalent-metal salt is added in an amount of 70 mmol to 700 mmol per 1,000 g of the hydrophobic compound fine particles in the emulsion.

9. The emulsified dispersion of photographic hydrophobic compound fine particles as claimed in claim 8, wherein the metal salt is a nitrate.

10. The dispersion as claimed in claim 1, wherein the water-soluble polyvalent-metal salt is added in an amount of 7 mmol to 70 mmol per 1,000 g of the hydrophobic compound fine particles in the emulsion.

11. The emulsified dispersion of photographic hychophobic compound fine particles as claimed in claim 1, wherein the photographic hydrophobic compound is dissolved in the high-boiling organic solvent to form a solution, and the solution is mixed with an aqueous medium containing gelatin to obtain the emulsion.

12. A silver halide photographic light-sensitive material which comprises, in at least one hydrophilic colloid layer on a support, a dispersion which dispersion comprises an added water-soluble monovalent- or polyvalent-metal inorganic salt in a prescribed amount required for lowering the surface tension in association with an anionic surfactant, wherein photographic hydrophobic compound fine particles are emulsified by use of an anionic surfactant, in the form of fine oil droplets dissolved in a high-boiling organic solvent that is solid or liquid at room temperature.

13. The silver halide photographic light-sensitive material as claimed in claim 12, wherein the water-soluble monovalent- or polyvalent-metal salt is selected from the group consisting of nitrates and carbonates, and wherein the dispersion contains photographic hydrophobic compound fine particles (with the proviso of excluding silver halides).

14. The silver halide photographic light-sensitive material as claimed in claim 12, wherein the metal salt is a nitrate.

15. The silver halide photographic light-sensitive material as claimed in claim 12, wherein the photographic hydrophobic compound is a coupler or a color-mixing inhibitor.

16. The silver halide photographic light-sensitive material as claimed in claim 12, wherein the metal salt is a carbonate.

17. The silver halide photographic light-sensitive material as claimed in claim 12, wherein the photographic hydrophobic compound is a coupler or a color-mixing inhibitor.

18. The silver halide photographic light-sensitive material as claimed in claim 12, wherein the water-soluble monovalent-metal salt is added in an amount of 70 mmol to 700 umol per 1,000 g of the hydrophobic compound fine particles in the emulsion.

19. The silver halide photographic light-sensitive material as claimed in claim 12, wherein the water-soluble polyvalent-metal salt is added in an amount of 7 mmol to 70 mmol per 1,000 g of the hydrophobic compound fine particles in the emulsion.

20. The silver halide photographic light-sensitive material as claimed in claim 12, wherein the photographic hydrophobic compound is dissolved in the high-boiling organic solvent to form a solution and the solution is mixed with an aqueous medium containing gelatin to obtain the emulsion.

21. A method for emulsifying photographic water-insoluble compound fine particles, which photographic hydrophobic compound fine particles are emulsified in the form of fine oil droplets dissolved in a high-boiling organic solvent that is solid or liquid at room temperature, wherein a water-soluble monovalent- or polyvalent-metal inorganic salt in a prescribed amount required for lowering the surface tension in association with an anionic surfactant is added.

22. The method for emulsifying as claimed in claim 21, wherein the water-soluble monovalent- or polyvalent-metal salt is selected from the group consisting of nitrates and carbonates.

23. The method of producing an emulsified dispersion of photographic hydrophobic compound fine particles as claimed in claim 22, wherein the water-soluble monovalent- or polyvalent-metal salt is added into an aqueous medium before the completion of emulsification.

24. The method for emulsifying as claimed in claim 21, wherein the water-soluble monovalent- or polyvalent-metal salt is selected from the group consisting of nitrates and carbonates, and wherein the water-soluble monovalent- or polyvalent-metal salt is added into an aqueous medium after the completion of emulsification of the photographic hydrophobic compound.

25. The method for emulsifying as claimed in claim 21, wherein the water-soluble monovalent- or polyvalent-metal salt is selected from the group consisting of nitrates and carbonates, and wherein the water-soluble monovalent- or polyvalent-metal salt is added into an aqueous medium before the completion of emulsification of the photographic hydrophobic compound, for atomizing the particle size after emulsification to 0.30 $\mu$m or less.

26. The method for emulsifying as claimed in claim 21, wherein the water-soluble monovalent- or polyvalent-metal salt is added for atomizing the particle size after emulsification of the photographic hydrophobic compound to 0.30 $\mu$m or less.

27. The method for emulsifying as claimed in clam 21, wherein the water-soluble monovalent-metal salt is added in an amount of 70 mmol to 700 mmol per 1,000 g of the hydrophobic compound fine particles in the emulsion.

28. The method for emulsifying as claimed in claim 21, wherein the water-soluble polyvalent-metal salt is added in an an amount of 7 mmol to 70 mmol per 1,000 g of the hydrophobic compound fine particles in the emulsion.

29. The method for emulsifying photographic water-insoluble compound fine particles as claimed in claim 21, wherein the photographic hydrophobic compound is dissolved in the high-boiling organic solvent to form a solution, and the solution is mixed with an aqueous medium containing gelatin to obtain the emulsion.

* * * * *